US006062370A

United States Patent [19]

Nikolayev et al.

[11] Patent Number: 6,062,370

[45] Date of Patent: May 16, 2000

[54] COIN COUNTER ASSEMBLY FOR PUSH-PULL COIN MECHANISM FOR VENDING AND ARCADE MACHINES AND APPLIANCES

[75] Inventors: Nikolay Nikolayev, Flushing; Elliott Porco, Tuckahoe, both of N.Y.

[73] Assignee: Nova Resolution Industries, Inc., Bronx, N.Y.

[21] Appl. No.: 09/159,160

[22] Filed: Sep. 23, 1998

Related U.S. Application Data

[63] Continuation-in-part of application No. 08/842,677, Apr. 15, 1997, Pat. No. 5,950,794, and a continuation-in-part of application No. 09/065,504, Apr. 24, 1998, Pat. No. 5,909,795.

[51] Int. Cl.[7] ..... G07D 5/22

[52] U.S. Cl. ..... 194/219; 194/230; 194/244

[58] Field of Search ..... 194/219, 220, 194/221, 223, 230, 231, 235, 238, 239, 240, 241, 242, 243, 244, 245; 377/7

[56] References Cited

U.S. PATENT DOCUMENTS

| | | | |
|---|---|---|---|
| 1,355,583 | 10/1920 | Zeidler . | |
| 1,926,652 | 9/1933 | Rosenfeld . | |
| 2,818,213 | 12/1957 | Pearl | 377/7 |
| 3,783,986 | 1/1974 | Bolen . | |
| 4,143,749 | 3/1979 | Otten . | |
| 4,216,461 | 8/1980 | Werth et al. . | |
| 4,369,442 | 1/1983 | Werth et al. . | |
| 4,376,479 | 3/1983 | Sugimoto et al. . | |
| 4,392,564 | 7/1983 | Hayashi . | |
| 4,566,033 | 1/1986 | Reidenouer | 194/241 X |
| 4,981,024 | 1/1991 | Beldham | 194/243 X |
| 5,174,427 | 12/1992 | Glaser . | |
| 5,201,396 | 4/1993 | Chalabian et al. . | |
| 5,386,901 | 2/1995 | Ibarrola et al. | 194/244 |
| 5,755,618 | 5/1998 | Mothnurf | 453/58 X |

*Primary Examiner*—F. J. Bartuska
*Attorney, Agent, or Firm*—Michael R. Gilman, Esq.; Koplan & Gilman, LLP

[57] ABSTRACT

A coin counter is provided for push-pull coin vending machines, arcade machines and pay-per-use appliances. The counter comprises a bracket assembly having first and second chambers. The first chamber for receiving, processing and expelling a coin, and the second chamber having a switch assembly which is interactive with the coins moving through the first chamber by means of an actuator arm so as to register counts on a connected numeric display. The counter further comprises a stop which receives the weight of the coins processed through the machine and also redirects the coins, allowing the actuator arm to rotate in a reduced arc than the prior art.

18 Claims, 11 Drawing Sheets

COIN COUNTER ASSEMBLY FOR PUSH-PULL COIN MECHANISM FOR VENDING AND ARCADE MACHINES AND APPLIANCES

This application is a continuation-in-part of application Ser. No. 08/842,677, filed Apr. 15, 1997, now U.S. Pat. No. 5,950,794, and a continuation-in-part of application Ser. No. 09/065,504, filed Apr. 24, 1998, now U.S. Pat. No. 5,909,795.

BACKGROUND OF THE INVENTION

The invention relates to the field of vending and arcade machines and appliances, and more particularly, to such machines and appliances which only operate after receipt of coins or tokens into a coin mechanism.

Vending machines consist, in general, of two types of machines; single item vending machines and bulk vending machines. Both single item and bulk vending machines are old in the art. Single item vending machines are normally associated with those machines used for dispensing a particularly chosen item to a user of the machine. For example, a user of a single item vending machine will insert the required amount of money, represented by coins (tokens) or bills, into the machine and will then have an opportunity to select from a variety of different items. These items can include different types of snacks (candy bars, potato chips, pretzels, gum, breath mints, etc.), drinks (soda, fruit juices, water, etc.) or ice cream (sandwiches, pops, cones, etc.).

In contrast, a bulk vending machine does not normally lend itself to giving the user of a machine a choice between the goods to be selected. In general, bulk vending machines hold large quantities of a particular type of item (gum balls, nuts, trail mix, toys, balls, etc.) in a large, usually top mounted, receptacle. By placing coin(s), or in some instances, a specially designed token which resembles a coin, into the coin mechanism of the bulk vending machine, one, or a handful, of the items within the receptacle are dispensed for receipt by the user. In these machines, no choice has been given to the user, and the user will receive whichever item, or items, are next in line to be dispensed.

Parents will now clearly understand the distinction between single item vending machines and bulk vending machines; single item vending machines give their child a choice and the child walks away happy and content, while bulk vending machines distribute what they want to the awaiting hands of the child, and no matter how much screaming and ranting by the child, he/she will have to eat the blue gum ball, even though he/she really wanted a green gum ball.

In this specification, "coin" will refer to either regular legal tender (i.e., in the United States, quarters, dimes, etc.), or tokens (sometimes referred to as slugs), which are purchased by a person for use in a vending/arcade machine when regular legal tender is not accepted into the machine.

Vending machines, whether they are single item or bulk, as discussed above, can themselves be of two particular types: (1) those having coin mechanisms which use rotating handles mounted around a substantially, centrally mounted axial rod, and a cam also mounted around the rod; or (2) those having coin mechanisms which receive at one time from one to a line of multiple coins, on a slotted lever extending from the machine, which is operated by pushing the lever into the machine and then pulling it out of the machine to deposit the coins into the machine. The rotating handle machines discussed immediately above, and counters for such machines, are the subjects of co-pending U.S. patent application Ser. Nos. 08/842,677 and 09/065,504. This application will address coin counters for the second type of single item or bulk vending machine discussed immediately above, the push-pull machine. These push-pull mechanisms are also regularly found on arcade machines (such as pool tables), and publically accessible appliances, such as washers and dryers in Laundromats.

Since bulk vending machines are normally not powered by plugging them into an AC power outlet, but instead operate through standard mechanics, the bulk vending industry has never had a successful way of counting the money received into bulk vending machines. Today's standard methods for determining the amount of vends which have occurred, and the coins inserted into a given machine during a certain period of time, are by hand-held coin counters and weight scales. These methods make the collection process very time consuming and leave no hope for any sense of security, nor for the possibility of building any kind of financial history for the particular machine by the owner or lease holder of the machine.

However, even if AC power were required to operate bulk vending machines (as is required for most single item vending machines, arcade games and pay-per-use appliances), using AC powered counters is disadvantageous due to possible electrical conversion problems for the particular counter and the AC power source, due to the fact that it is inherently more dangerous to use an electrically powered counter, as opposed to a mechanically operated, self-contained counter, and due to possible loss of the counting records from electrical outages.

As is evidenced by the counting mechanisms of U.S. Pat. Nos. 5,201,396, 4,392,564, 4,376,479, 4,369,442, 4,216,461 and 4,143,749, the prior art discloses attempts to insert counters into vending machines. These prior art counters have the disadvantages of requiring a separate AC power source and the need of an associated power converter to provide the low voltage power needed to the meter. These prior art counters also disclose mechanisms having computers attached thereto, mechanisms for determining the value of the coins deposited, and mechanisms for counting the value of the items exiting the machine. All of these counters are hindered by deficiencies in size, power source, the complicated nature of their operation, safety and data retrieval should there be a power outage.

In addition, there was previously used a counter assembly for drop-coin vending machines, arcade machines and appliances. A sample of this type of prior art counter assembly is shown in FIGS. 10A–10C of the drawings to this application. While similar to the subject invention, the prior art drop-coin counter assembly of FIGS. 10A–10C would not work if installed into a push-pull coin mechanism. There are a number of reasons for this failure: a push-pull mechanism will usually be used by operators needing a multiple coin drop; due to the nature of its construction and functioning the prior art counter assemblies of FIGS. 10A–10C regularly break due to the weight of the coins, full rotation of the actuator arm of the counter, and tampering with the actuator arm by a technician trying to fix a jam of coins. These disadvantages of the prior art counters of FIGS. 10A–10C will be discussed in more detail later in this specification.

The vending, arcade and pay-per-use appliance industries that use push-pull coin mechanisms are crying out for a small, self powered (not requiring an external AC power source) counting mechanism to assist them in monitoring the flow of coins into and out from their machines. Accordingly, it would be desirable to provide a coin counter for push-pull coin vending machines, arcade machines and pay-per-use appliances. It would also be desirable for these counters to need no external AC power source, to be sized so as to fit within the restricted space limitations of all of these machines, to be accurate, and to be easily read.

SUMMARY OF THE INVENTION

In accordance with the invention, a coin counter is provided for push-pull coin vending machines, arcade machines and pay-per-use appliances. The counter comprises a bracket assembly having first and second chambers. The first chamber for receiving, processing and expelling a coin, and the second chamber having a switch assembly which is interactive with the coin moving through the first chamber by means of an actuator arm so as to register consecutive counts on a connected numeric display. The counter further comprises a stop which receives the weight of the coins processed through the machine and also redirects the coins, allowing the actuator arm to rotate in a reduced arc than the prior art.

Accordingly, it is an object of the invention to provide a coin counter for push-pull coin mechanisms to be used in the vending industry, the arcade industry and the pay-per-use appliance industry.

Still another object of the invention is to provide a coin counter for push-pull coin mechanisms which is sized to fit directly under the push-pull coin mechanism and within the limited space provided in vending and arcade machines and in pay-per-use appliances.

Yet another object of the invention is to provide a coin counter for push-pull coin mechanisms which is not powered by an outside AC power source.

Still a further object of the invention is to provide security and peace of mind to the owner/lease holder of push-pull coin mechanism machines by enabling them to have independent and accurate counting of coins deposited into a their machines.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
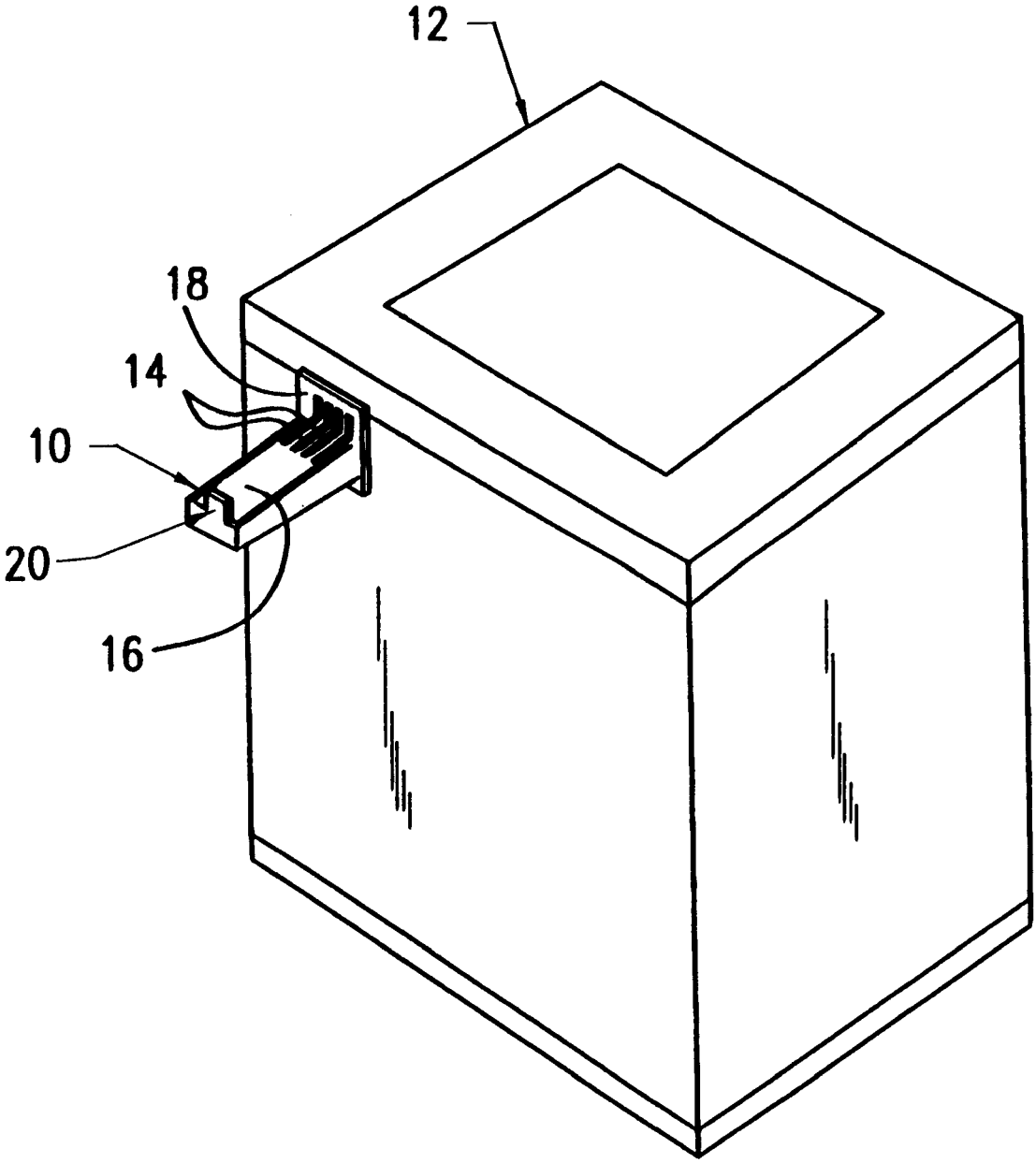
FIG. 1 is a perspective view of a push-pull coin mechanism extending from a vending machine, arcade machine and/or pay-per-use appliance.

Referring first to FIG. 1, a push-pull coin mechanism 10 is seen protruding from a generic vending machine, arcade machine or pay-per-use appliance 12. The portion of coin mechanism 10 which is visible in FIG. 1 shows four slots 14 for receiving coins. The slots 14 are shown to be both in a substantially horizontal plate 16 and a substantially vertical plate 18.

In general, plate 16 is slidable within coin mechanism 10 through use of the extending handle 20. In practice, handle 20 is pushed by a person who has deposited coins into slots 14 until inward movement of plate 16 stops. Thereafter, the user pulls back on handle 20 so as to return plate 16 to its at-rest position (as shown in FIG. 1), this movement being assisted by a spring 26 (see FIGS. 6 and 7). When handle 20 is pulled back out, the coins which were originally placed into slots 14 by the user will now have disappeared into the machine/appliance 12. Presumably, for payment made, the user would also then have received the benefit of his/her payment, i.e., a prize or food out of the vending machine, the playing of an arcade game, or the operation of the pay-per-use appliance.

Directing attention now to FIG. 2, coin mechanism 10 is shown in side elevation, having attached thereto the coin counter assembly 100.

Figure 2A:
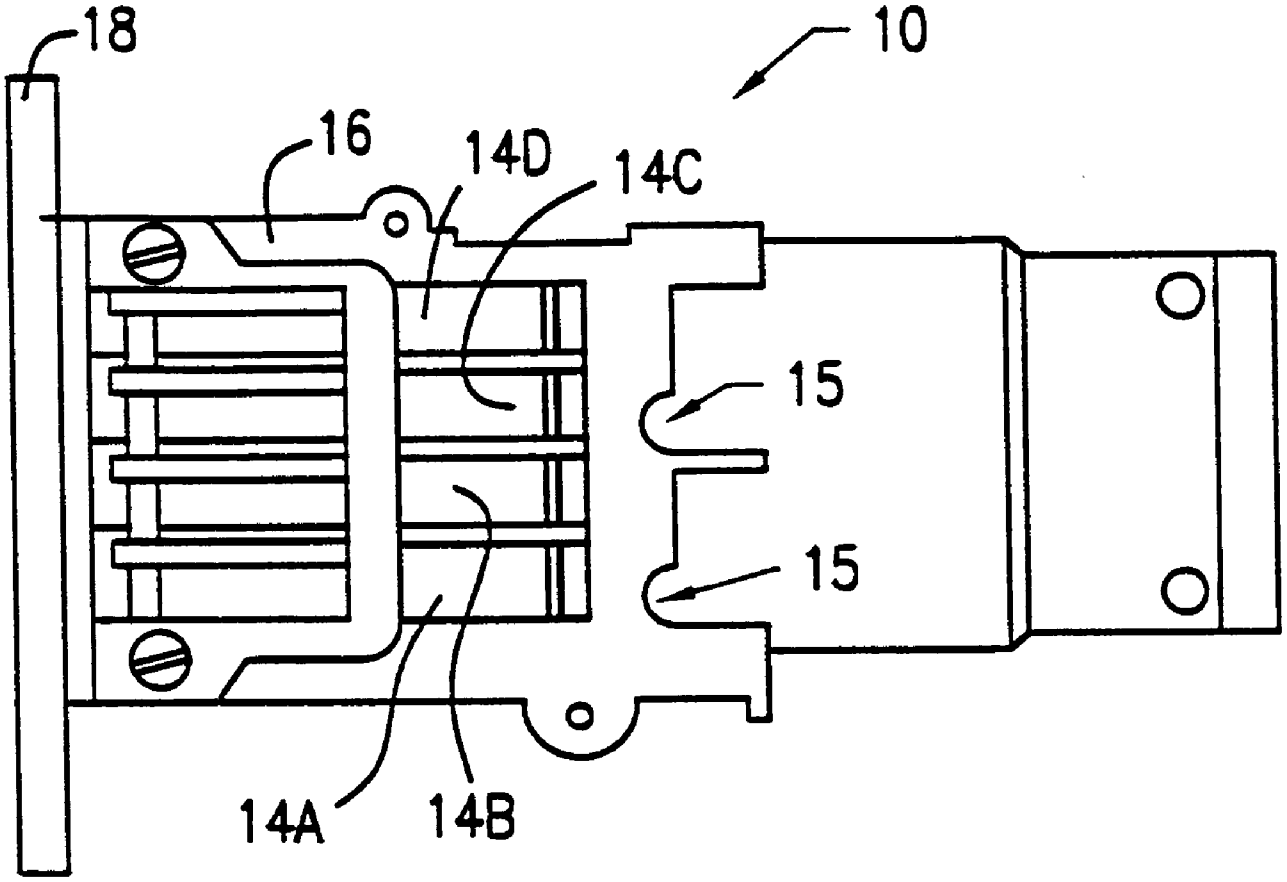
FIG. 2A is a bottom plan view of that portion of the coin mechanism of FIG. 1 which is located inside of a vending machine, arcade machine and/or pay-per-use appliance.

For purposes of this application, push-pull coin mechanism 10 is considered to be a standard coin mechanism which is presently used in the industry. To the knowledge of the inventors, push-pull coin mechanisms which are used today in the industry consist of two models. The only relevant difference between these two models is located at the point on mechanism 10 where coins 30 drop from mechanism 10 into the cashbox of the machine or appliance. In particular, as seen in FIG. 2A, which is a bottom plan view of this section of a coin mechanism, one of the push-pull mechanisms used in the industry today has a different drop-off point for every other slot 14. For example, assuming mechanism 10 is a four coin mechanism (having four slots 14), when handle 20 is pushed, causing coins 30 to pass through plate 18, coins 30 in slots 14A and 14C would reach their drop-off points slightly earlier than coins 30 in slots 14B and 14D.

As can be seen in FIG. 2A, the reason for the earlier drop off for some coins is due to the existence of notches 15 at the ends of slots 14A and 14C. Such a construction results in the coins dropping at different times into the below-waiting cashbox, because, simply, plate 16 on which the slots ride, ends earlier for slots 14A and 14C, then for slots 14B and 14D.

Turning back to FIGS. 2A and 2B, coin mechanism 10 is seen to have a continuation of plate 16 on the opposite side of plate 18, which was not visible in FIG. 1. As with plate 16 on the first side of plate 18, the portion of plate 16 on the other side of plate 18 also moves in a substantially horizontal plane and has extensions of slot 14 extending there along. Accordingly, when handle 20 is pushed by the user, coins 30 pass through slots 14 of plate 18, until coins 30 reach their respective drop-off points, as discussed above.

Figure 6:
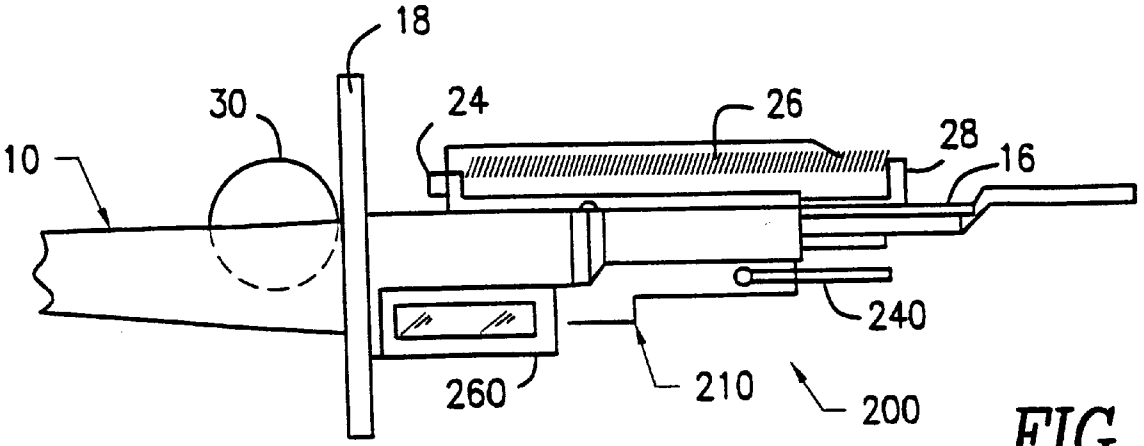
FIG. 6 is a side elevational view of a second embodiment of a coin counter to be used with a push-pull coin mechanism, showing the push-pull mechanism in an at rest position.
Figure 7:
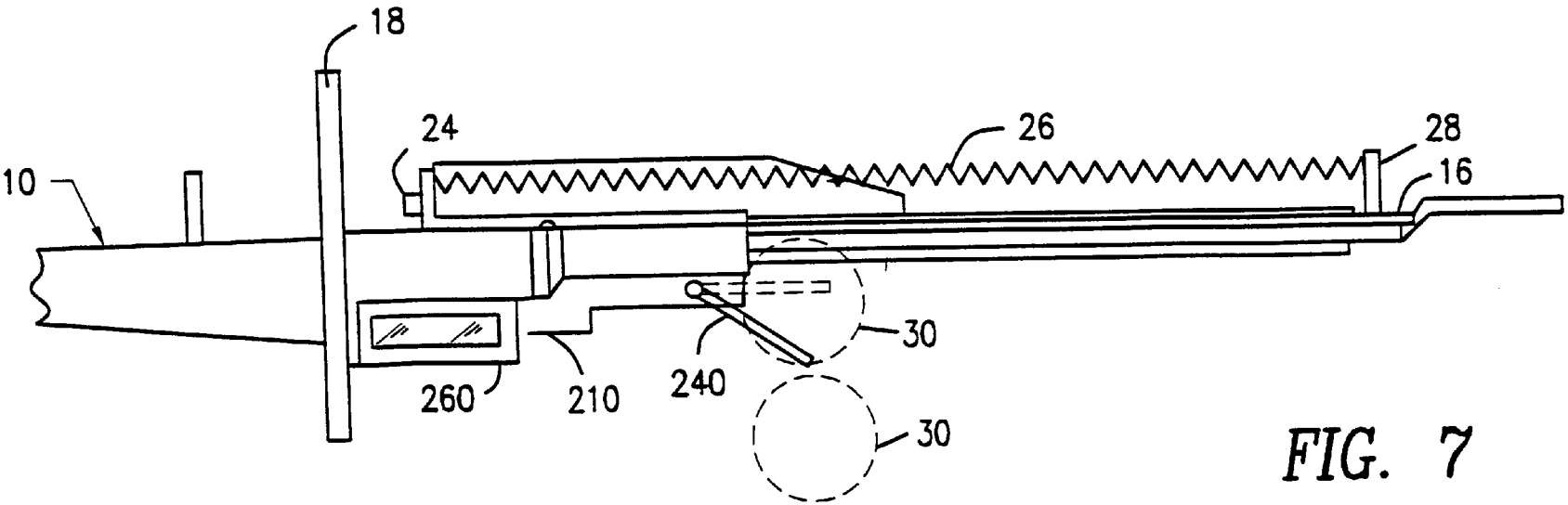
FIG. 7 is a side elevational view of the counter and push-pull mechanism of FIG. 6, showing the mechanism in an active state.

Reflecting more upon the simple mechanics of push-pull coin mechanism 10, mechanism 10 has a spring 26 which is selectively extendable between a first end 24 and a second end 28 (see FIGS. 6 and 7). The purpose of spring 26 is to tension plate 16 backward, toward the user who is pushing upon handle 20, so as to help return plate 16 to its at-rest position as shown in FIG. 1.

In the past, before the counter of the present invention, coins 30 reaching their drop-off points along mechanism 10 would simply fall into a receiving cashbox (not shown), for later collection by the vendor/operator, a specifically paid collection service, a refilling service, or the lessee of the machine or appliance. As with the coin counters for the rotating coin mechanisms of co-pending application Ser. Nos. 08/842,677 and 09/065,504, without any means of monitoring the person who collects the coins from the vending machines or appliances, there is really no manner of determining whether the owner/licensee of the particular machine or appliance is having money stolen. Only through use of the counting assembly of the subject application will strict supervision and monitoring of these vending machines and appliances, and their associated collection operations be achieved.

Directing attention now to FIGS. 2–5, coin counting assembly 100 is comprised of a bracket assembly 110 which is attached to coin mechanism 10 in such a way that coins 30, after they have exited over their drop-off point, activate a switch 130 which registers a sequential count on an attached numeric display 160. For purposes of this invention, when we speak of a sequential Acount being registered, a standard 1, 2, 3, etc. count is not necessarily intended; but of course could be. Instead, one sequential count will depend upon the number of coins 30 actually received into the machine from coin mechanism 10. For example, a coin mechanism 10 which holds 4 quarters will register, if the user so desires, one sequential count equal to 4, with the next sequential count going to 8, and so on. In this way, the actual amount of coins received into the machine is recorded on the numeric display. It is also to be understood herein, that the vending industry speaks in terms of "vends"; i.e., no matter how many coins are used, the whole process of depositing coins into the machine and receiving something back is called "one vend."

Figure 3A:
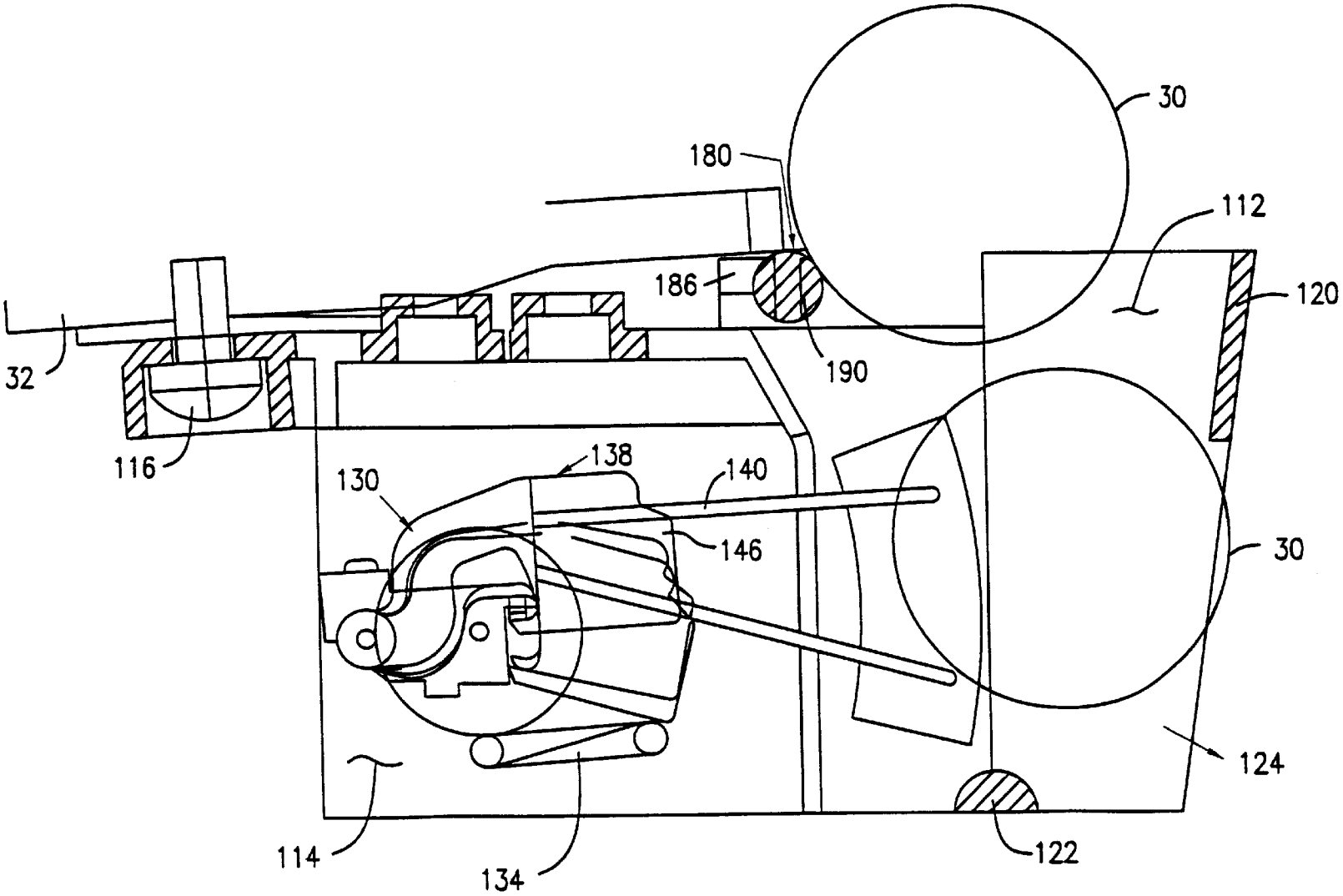
FIG. 3A is an enlarged side elevational of the coin counter of FIG. 2B.

For all intents and purposes, bracket assembly 110 is divided into first and second chambers 112 and 114. While the actual dividing of bracket assembly 110 into two separated chambers is not essential to the construction of bracket assembly 110, reference to two separate chambers is made throughout this specification for ease of defining the locations of the parts of coin counter assembly 100. In particular, it is seen from the figures that bracket assembly 110 is attached to coin mechanism 10 at the second chamber 114. In particular, a set of screws 116 (only one being visible in the drawings), is best seen in FIG. 3A attaching a top member 118 of bracket assembly 110 onto a fixed lower member 32 of coin mechanism 10. Bracket assembly 110, and its associated elements, switch 130 and numeric display 160, are not very large or very heavy, and are therefore conveniently and easily secured to coin mechanism 10 by use of screws 116.

Figure 3B:
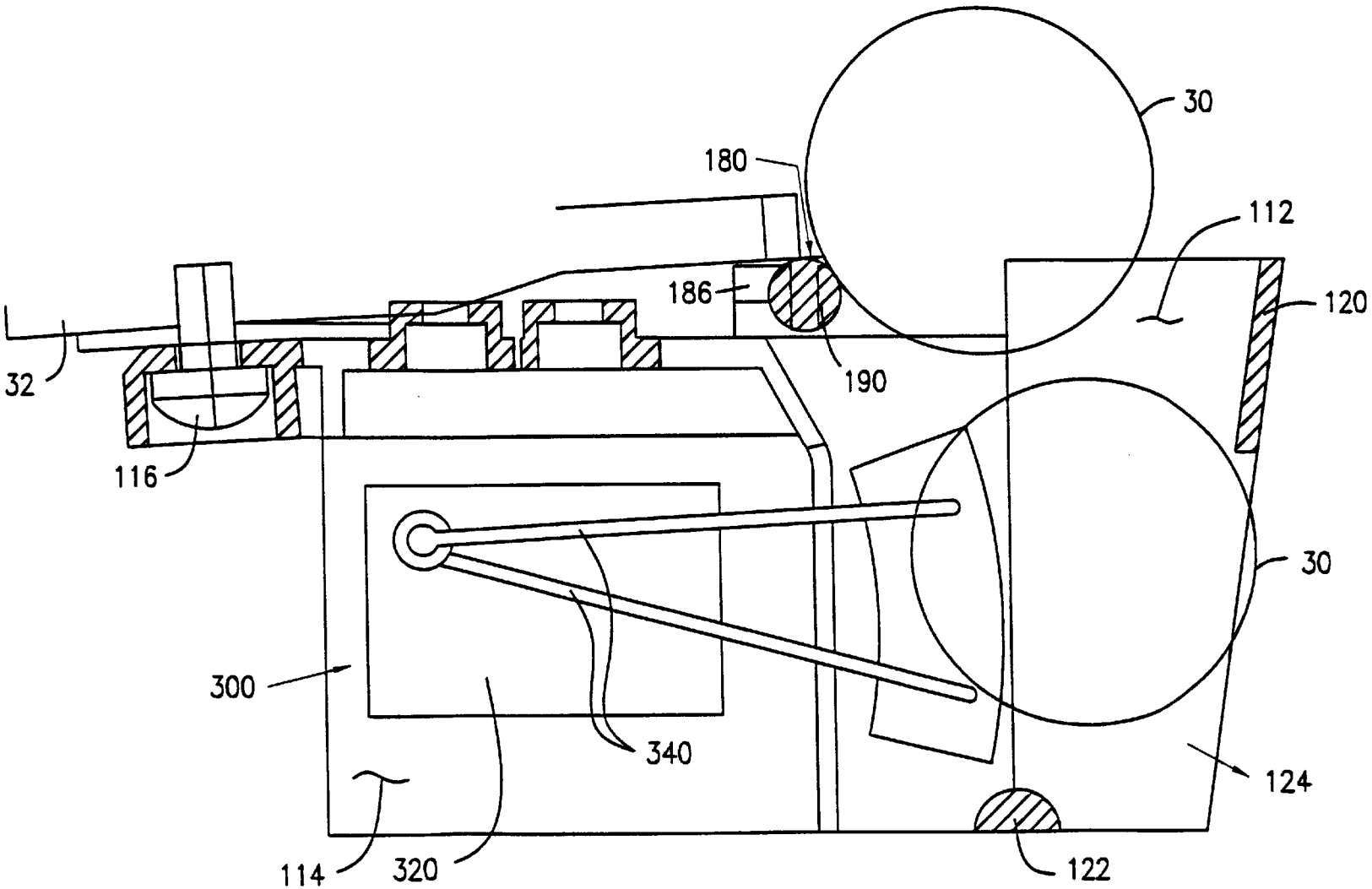
FIG. 3B is an enlarged side elevational of another embodiment of the coin counter of the subject invention.
Figure 4:
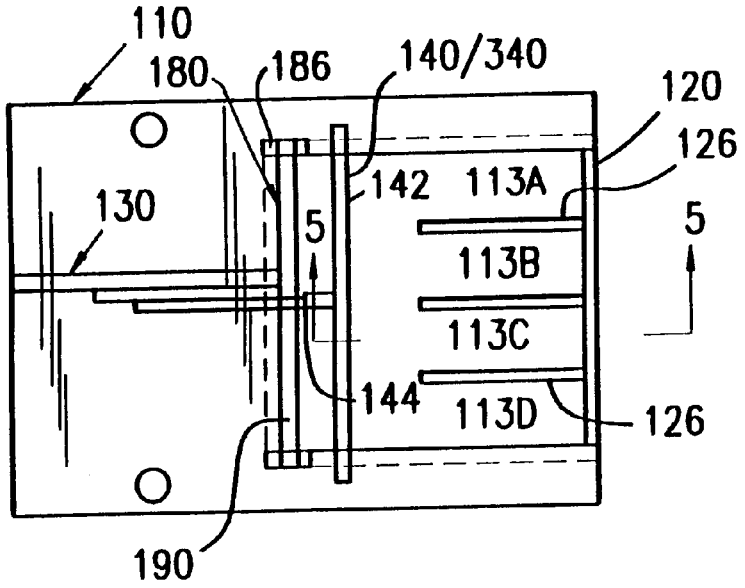
FIG. 4 is a top plan view of a counter made in accordance with the invention.

As seen in FIGS. 3A and 3B, and to overcome the hindrance and distinction between the two models of push-pull coin mechanisms which are currently in the market, a rod assembly 180 is seen mounted across the top of element 118 of bracket assembly 110. In particular, as seen in FIG. 4, rod assembly 180 is comprised of a rod having a length which is substantially equal to the width of assembly 110. Rod assembly 180 is secured to element 118 of assembly 110 at each of its ends 182 and 184, within mounts 186 and 188. Rod 190 of rod assembly 180 is preferably made having a cross-section which is substantially circular, so as to help avoid the creation of ruts and grooves by the constant contact of coins 30, which might be created if rod 190 had a square cross-section.

In particular, as best seen in FIGS. 3A and 3B, coins 30, instead of simply dropping off of plate 116 of coin mechanism 10 into a cash receptacle, now roll across a portion of the surface area of rod 190 before dropping through bracket assembly 110, and into the cash receptacle. The purpose of rod assembly 180 is to equalize the distance traveled in a substantially horizontal direction by coins 30 prior to dropping off of coin mechanism 10 and into the cash receptacle.

As was previously discussed, the difference between the two models of push-pull coin mechanisms which are presently in the industry is that one of the mechanisms has a varied drop-off floor for alternate pairs of coins. By attaching rod assembly 180 directly at the location where the drop-off occurs, thereby extending the substantially horizontal distance traveled by coins 30, an equalization effect occurs so that coins 30 drop substantially simultaneously off of rod 190 into a coin receptacle. By so creating this equalized drop-off, the negative effect of double counting is substantially reduced.

Continuing with a discussion of bracket assembly 110 of coin counter assembly 100, attention is continued with FIGS. 2–5. After coins 30 leave rod 190 on their substantially vertical drop into a coin receptacle, they travel through first chamber 112 of assembly 110, thereby interacting directly with actuator arm 140 of switch 130. In this processing stage of coins 30 through chamber 112, it is the movement of actuator arm 140 of switch 130 which causes numeric display 160 to advance one sequential count.

Continuing with a discussion of how coins 30 travel through first chamber 112 of assembly 110, it is noted that immediately after leaving rod 190, each of coins 30 might have partial horizontal and partial downward, vertical momentum. In order to stop coins 30 from traveling too far in the horizontal direction, and thereby miss counter assembly 100, bracket assembly 110 is provided with a horizontal stop 120 (best seen in FIGS. 2B and 5). Stop 120 extends substantially the entire width of bracket assembly 110, and would therefore have a length similar to that of rod 190.

After contacting stop 120, coins 30 will travel in a substantially, wholly downward vertical direction through chamber 112 of bracket assembly 110. In their downward vertical drop through chamber 112, coins 30 will hit actuator arm 140 of switch 130, causing switch 130 to rotate into a closed position. The rotating movement of switch 130 is best seen in FIGS. 2B and 5.

In particular, in FIGS. 2B, 2C and 5, it is seen that the subject actuator arm 140 will only rotate 15° from its at-rest position (prior to coins 30 dropping through chamber 112), to its fully downwardly displaced position in the subject invention (when coins 30 hit stop 122, discussed below). In fact, it is the existence of stop 122 which ensures, amongst other things, that rotation of actuator arm 140 is not to large, but is certainly not to the end of the rotational cycle of actuator arm 140, as happens in the prior art counter assembly shown in FIGS. 10A–10C.

Figure 2B:
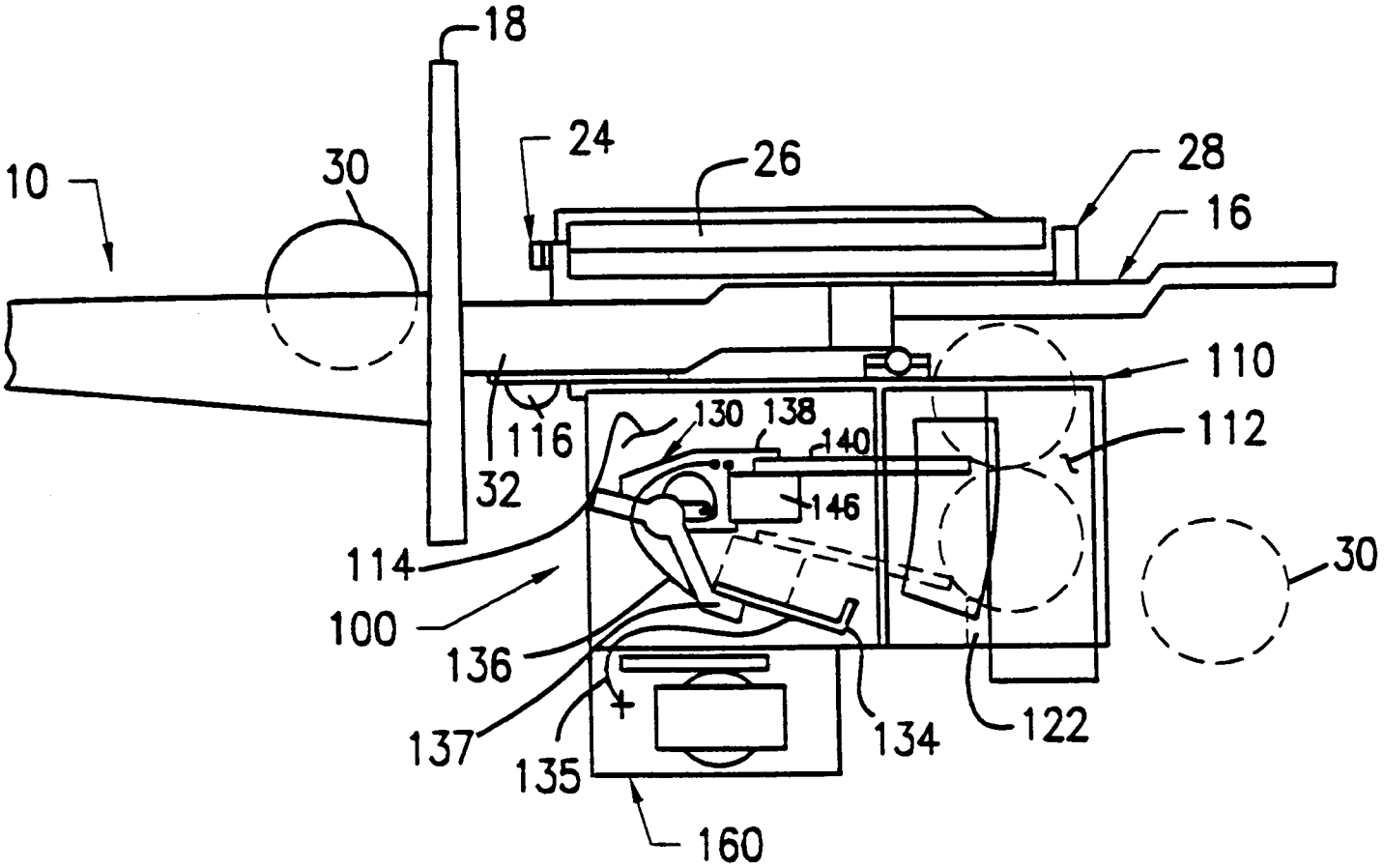
FIG. 2B is a side elevational view of one embodiment of the coin counter of the invention attached onto and immediately below a portion of a coin mechanism for a push-pull coin mechanism, showing a first reed-switch assembly.
Figure 2C:
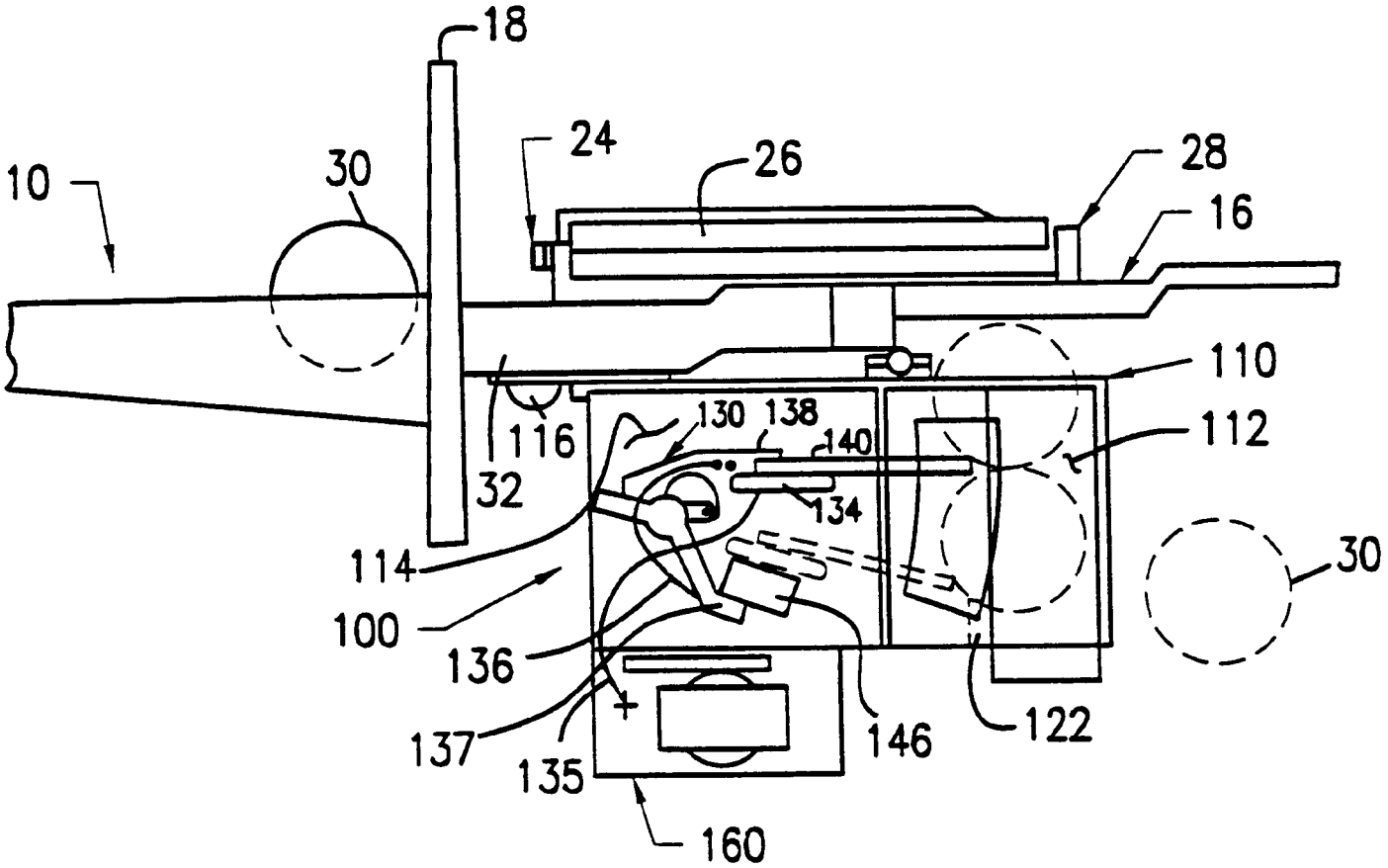
FIG. 2C is a side elevational view of another embodiment of the coin counter of the invention attached onto and immediately below a portion of a coin mechanism for a push-pull coin mechanism, showing an alternate reed-switch assembly.
Figure 5:
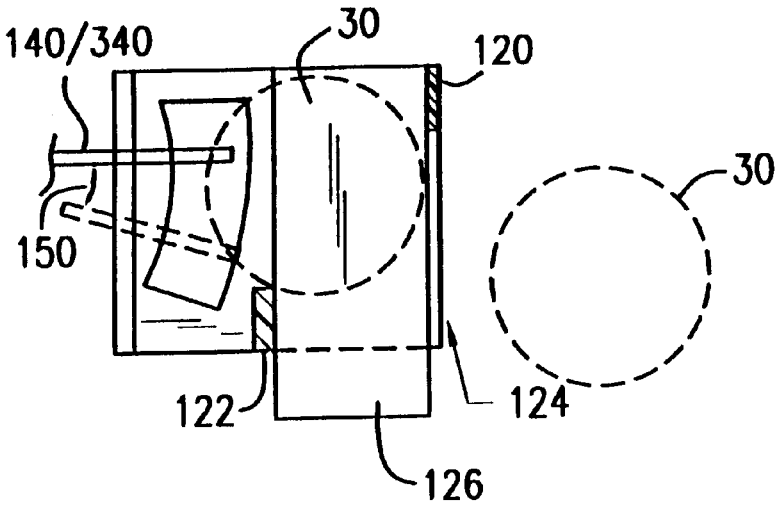
FIG. 5 is a cross-sectional view taken along line 3—3 of FIG. 4.

As seen in FIGS. 2B, 2C and 5, at the bottom of first chamber 112, after actuator arm 140 has been activated by the dropping of coins 30, coins 30 will again have their velocity changed, this time by hitting against stop 122. Stop 122 is seen in FIGS. 2B, 2C, 3A, 3B and 5. The embodiment shown is FIGS. 2B, 2C and 5 is of a simple, substantially rectangular member extending upward from the bottom of bracket assembly 110 into chamber 112, while the embodiment shown in FIGS. 3A and 3B are of a rounded member 122. The preferred cross-sectional construction of member 122 is not necessarily important to the invention. What is important, however, is that stop 122 receives the full weight of dropping coins 30, and redirects those coins so that they exit chamber 112 of bracket assembly 110 through exit opening 124.

Further describing the intended purposes of the existence of stop 122, a comparison will now be made between stop 122 of the subject invention, and actuator arm 340 of the prior art counter device of FIGS. 10A–10C. Two important differences will be made regarding the weight of coins 30 and the rotation of actuator arms 140 and 340.

First, in the prior art device, it was actuator arm 340 which received the full weight of any coin(s) dropped into the machine by a user. Second, in the prior art device actuator arm 340 was caused to rotate a full 30° to 45°; to a position equivalent to the arm's full rotational swing.

Figure 10A:
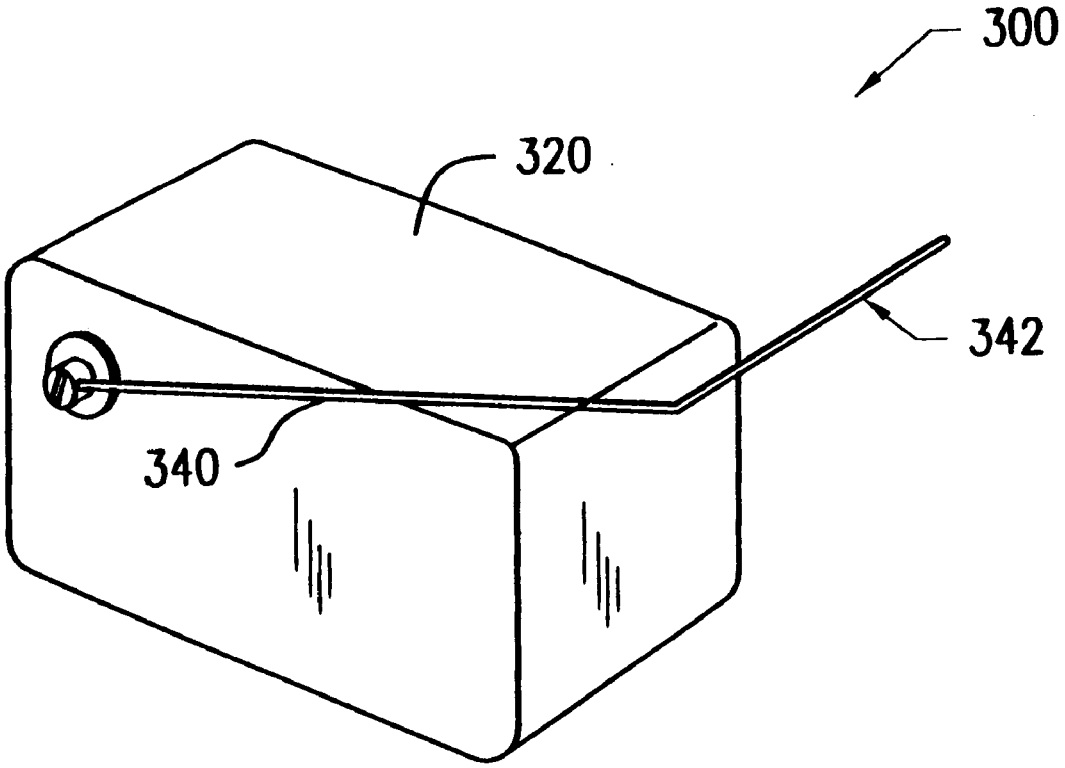
(PRIOR ART) FIG. 10A
FIG. 10A is a perspective view of a prior art micro-switch counter assembly for drop-coin machines.
Figure 10B:
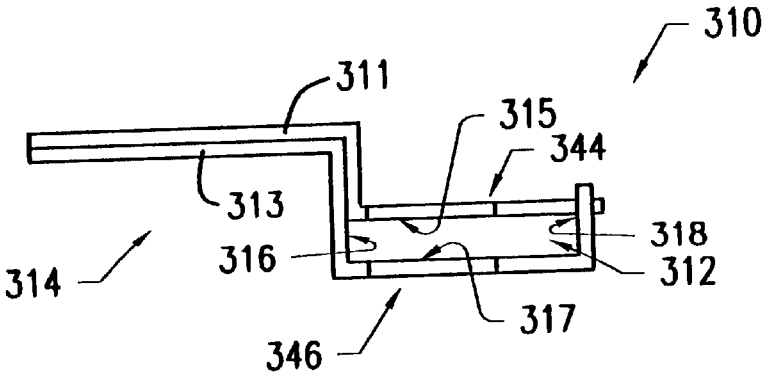
(PRIOR ART) FIG. 10B
FIG. 10B is a top plan view of a bracket assembly for the prior art counter of FIG. 10A.
Figure 10C:
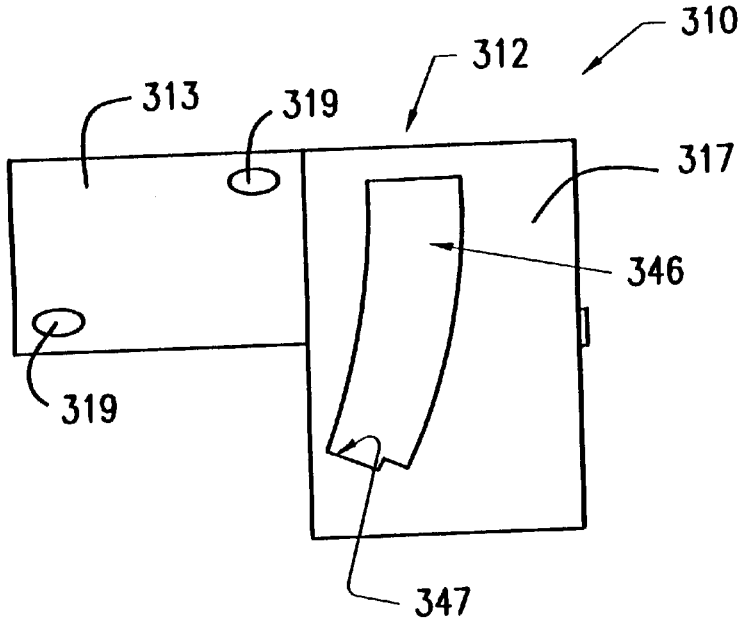
(PRIOR ART) FIG. 10C
FIG. 10C is a front elevational view of the bracket assembly of FIG. 10B.

Directing attention to FIGS. 10A–10C, one will see that prior art bracket assembly 310, is comprised of two plates 311 and 313. As with our earlier discussion of bracket assembly 110, we will describe the construction of bracket assembly 310 as having two chambers, a first chamber 312 and a second chamber 314.

First chamber 312 is defined between walls 315, 316, 317, and 318. Wall 315 is part of plate 311, while walls 316, 317 and 318 are part of plate 313. Chamber 312 is such that a coin (not shown), passes through the chamber in a downward vertical direction, in essentially a free fall, after being deposited into the drop-coin mechanism of the particular drop-coin machine.

The rest of plates 311 and 313, making up second chamber 314, are substantially side-by-side, and are secured together and to a portion of the machine (not shown) through screw holes 319 and screws (not shown). Secured within chamber 314, is micro-switch 300. While not shown in such an attached configuration in the drawings, one need only imagine that body 320 of micro-switch 300 is within chamber 314, and that in that position, actuator arm 340 has portion 342 thereof (see FIG. 10A) extending into and through chamber 312.

Portion 342 extends through openings 344 and 346 in walls 315 and 317, respectively. Opens 344 and 346 are also useful in order to allow a person servicing the machine, and/or collecting the coins deposited into the machine, to reach coins which are jammed within chamber 312, and dislodge them for future operation of the machine.

Openings 344 and 346 have bottom sides 345 (not shown) and 347, respectively, as is best seen in FIG. 10C. In operation, a coin dropping through chamber 312 will push down upon portion 342 of actuator arm 340, until actuator arm 340 has arrived at its point of full rotation, approximately 30°–45° later, at around bottom sides 345 and 347. As originally constructed, in this position, actuator arm 340 on bottom sides 345 and 347 was suppose to be have been so situated as to be out of the way of the dropping coin. The coin would then exit chamber 312 directly straight down, and into the awaiting cash receptacle. Unfortunately, in actuality, few if any of these prior art devices ever worked as intended.

Instead, what is normally experienced in the field is that very shortly after insertion into a machine, assembly 310 would jam because actuator arm 340 shifted ever so slightly, or bent. Thereafter, because of the very tight space tolerances of assembly 310, even such a small shift in the location of actuator arm 340 would cause the arm to block the exit path of the coin. The coin would be jammed between arm 340 and wall 318. Accordingly, it has always been the case that even at full rotation, actuator arm 340 is not clear of the weight of the coin within chamber 312, or, as often happens, the weight of a number of jammed coins which unsuspecting people have dropped into the drop-coin mechanism while trying to operate the jammed machine.

In order to fix the jammed machine, the collector would need to open the machine, unjam the coin(s), and then either reposition the entire assembly 310 or bend actuator arm 340 until it no longer blocked the dropping coin. Again, unfortunately, this repair would only last so long and the collector would again have to unjam and fix the arm. After a number of such fixing procedures, arm 340 would snap off, thereby requiring full replacement. Through these movements and readjustments, the prior art device is subjected to repeated instances of breakage and malfunction. In contrast, the subject invention, through use of stop 122, avoids such breakage and malfunctioning problems.

In particular, because of the existence of stop 122, coins 30 dropping through chamber 112 never hit against a fully rotated and stopped actuator arm 140, but instead exert their full dropping weight upon stop 122. In fact, the subject device is further designed in such a way that when coins 30 are hitting stop 122, actuator arm 140 is safely to the side, and substantially out of the way of the weight of the coins (see FIGS. 2B, 2C and 5). In addition, the design of the subject invention, and in particular the rotation of only 15° of arm 140, allows arm 140 to never experience the impacts associated with full rotation, and therefore it avoids becoming misaligned and it avoids the associated recurrent breakage problems.

Accordingly, it is seen that the two advantages of the subject device over the prior art device, which allow the subject device to be used in push-pull machines while the prior art device could not be so used, are: (1) actuator arm 140 is not fully rotated, thereby avoiding breakage from its own hyper-rotation; and (2) actuator arm 140 does not receive the crushing, and often breaking force associated with stopping the free-falling coins.

We turn now to a final discussion of first chamber 112, as it is seen in FIG. 4. Here, in a top plan view of bracket assembly 110, it is seen that, in its preferred embodiment, first chamber 112 is divided into sub-chambers 113A, B, C and D. In the particular example shown in the drawings, bracket assembly 110 is configured for processing four coins 30 simultaneously, and therefore, it has four sub-chambers A, B, C, and D. The sub-chamber dividers 126 are there to prevent coins 30 from crashing into each other, thereby possibly disrupting their substantially smooth continuous flow through chamber 112 and out of exit opening 124.

It is further seen in FIG. 4 that actuator arm 140 of switch 130 is constructed, in one of the preferred embodiments, in the shape of the letter "T", having a first arm 144 extending outwardly of switch 130 between second chamber 114 and first chamber 112 of assembly 110 and a second, crossing arm 142. Arm 142 traverses the width of chamber 112, so as to achieve the effect of being hit by all of the coins 30 dropping vertically downward through chamber 112.

Continuing now with the discussion of switch 130, switch 130 is, in one of the preferred embodiments, essentially the same switch used in co-pending application Ser. No. 09/065, 504.

In another preferred embodiment(seen in FIG. 3B), however, switch 130 can be prior art micro-switch 300 of FIG. 10A, as has been discussed hereinabove. If the switch of the subject invention is, in fact, micro-switch 300, the reason it will now work in a push-pull machine, as is the purpose of the subject invention, is because of the introduction and use of stop 122. Simply, if micro-switch 300 is used in the subject invention, stop 122 will relieve it of all of the disadvantages discussed above in connection with a drop-coin machine; i.e., it will not receive the full weight of coins 30 and it will only rotate 15°. Accordingly, and to accommodate both preferred embodiments in the least number of drawings, hereinafter, when reference is made to either FIGS. 4 or 5, it will be assumed that any reference to actuator arm 140, is also reference to actuator arm 340.

Continuing again with a discussion of switch 130, as is best seen in FIGS. 2B and 2C, switch 130 comprises a bracket assembly 132, a reed-switch 134 and a spring assembly 136. Bracket assembly 132 comprises a first arm 137, having the reed-switch 134 attached thereto at a first end thereof, and a second arm 138 having a magnet 146 attached thereto at a first end thereof. Spring assembly 136 is attached between first arm 137 and second arm 138. First arm 137 is substantially fixed in its attachment to bracket assembly 110, while second arm 138 is selectively pivotal (rotatable) in its attachment to bracket 110.

Due to the pivotal nature of second arm 138, spring assembly 136 is tensioned in such a way as to hold second arm 138 in an open relationship to first arm 137 when switch 130 is in its at-rest (open) position, as shown in the solid line portion of FIG. 2B.

Switch 134 is comprised of two metal strips (not shown) held within a glass tube. The strips exist with a gap extending between them when switch 130 is in an at-rest position. Reed-switch 134 is connected to numeric display 160 by at least one lead 135. When reed-switch 134 is closed, bringing the metal strips into contact with each other, a count is registered on numeric display 160. In order for these strips to be forced to contact each other, the pivoting of second arm 138 must be caused so that magnet 146 comes close enough to reed-switch 134 to force its metal strips together. As was earlier discussed, when coins 30 are traveling through first chamber 112 of assembly 110, they reach a bottom most vertical location in their drop through chamber 112. In their drop, they are in contact with actuator arm 140, and as has also been discussed, the pushing down on actuator arm 140 causes switch 130 to rotate (pivot) bringing second arm 138 into close proximity with, or actual contact with, first arm 137. In this way, magnet 146 is brought to be in contact with, or close enough to, reed-switch 134 to cause its metal strips to contact each other and thereby add a number to numeric display 160.

As is shown in FIG. 2C, it is also anticipated that reed-switch 130 and magnet 146 can switch positions so that magnet 146 is on first arm 137, while reed-switch 130 is on second arm 138. In this way, it is reed-switch 130 which will pivot on second arm 138 to close with magnet 146 on fixed first arm 137.

Figure 8:
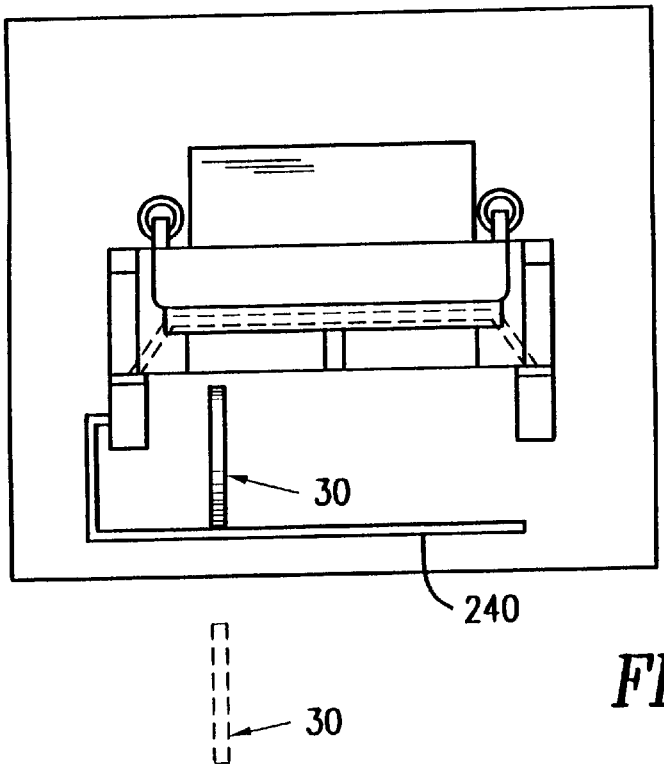
FIG. 8 is a front elevational view of the counter and push-pull mechanism of FIG. 6.

Directing your attention now to FIGS. 6–9, alternate embodiments of coin counter 100 are shown. In FIGS. 6–8, counter assembly 200 is seen to be reduced in scope to a bracket assembly 210, a pivot arm 240, and a numeric display 260.

Again, counter 200 is situated below coin mechanism 10 to take effect of the dropping of coins 30 when they reach the end of plate 16. Here, no fancy rod assembly 180 or stops 120 or 122 are used, just the arm 240 being hit by coins 30 as they drop, causing arm 240 to pivot and thereby advance the number shown in numeric display 260. Without rod assembly 180, double counting might be possible in this embodiment.

Figure 9:
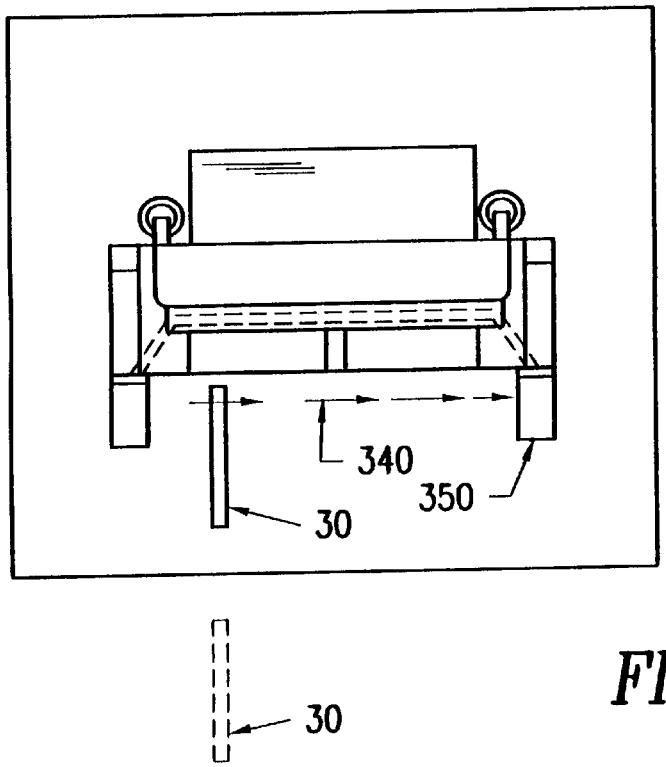
FIG. 9 is a front elevational view of a third embodiment of a coin counter to be used with a push-pull coin mechanism.

Turning to FIG. 9, a third embodiment of the subject invention is shown. In this embodiment, a laser-light beam 340 is directed across the path of dropping coins 30. When coins 30 drop through beam 340, beam 340 is deflected away from sensor 350. It is only when beam 340 is again unblocked by the full passage of coins 30, that it once again hits sensor 350 causing the numeric display associated with this embodiment to advance one number. Use of a laser-light source and receiving sensor presumably avoids a double counting problem, even without use of rod assembly 180 of embodiment one, since, for example, coins which start their vertical drop off of plate 16 at a slightly later time than a first set of such coins, would presumably still fall from plate 16 while the first set of coins are blocking beam 340. Therefore, there would be no re-contact of beam 340 with sensor 350 until the second set of coins had also completed their fall.

It will thus be seen that the objects set forth above, among those made apparent from the preceding description, are efficiently attained, and since certain changes may be made in the above constructions without departing from the spirit and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A switch assembly for attachment to a push-pull coin mechanism for counting coins deposited into a vending machine, an arcade machine or a pay-per-use appliance, comprising:

a switch bracket assembly;

a reed-switch attached to said switch bracket assembly at a first position along said switch bracket assembly;

a magnet attached to said switch bracket assembly at a second position along said switch bracket assembly, wherein said second position pivots in relation to said first position;

a spring assembly attached at least to said second position of said switch bracket assembly, for positioning said magnet in an open relation to said reed-switch for an at-rest position of said switch assembly; and a switch arm extending from proximate said second position of said switch bracket assembly and interactive with said coins dropping from said coin mechanism, so that when said coins interact with said switch arm, said second position pivots in relation to said first position and said reed-switch, thereby causing said magnet to move from said at-rest position to be proximate to said reed-switch, implementing said counting of said coins.

2. A switch assembly as recited in claim 1, wherein said counts of said coins are displayed on a numeric display connected to said switch assembly by at least one lead.

3. A switch assembly as recited in claim 1, said switch bracket assembly further comprising a first substantially fixed arm and a second selectively pivotal arm, wherein said reed-switch is attached to said first substantially fixed arm at a first end thereof, and said magnet is attached to said second selectively pivotal arm at a first end thereof.

4. A switch assembly as recited in claim 3, wherein said spring assembly is attached between said first and second arms of said switch bracket assembly, thereby positioning said second arm in an open relationship to said first arm.

5. A switch assembly as recited in claim 4, wherein said switch arm extends from a top portion of said second selectively pivotal arm of said switch bracket assembly so as to interact with said dropping coins.

6. A switch assembly for attachment to a push-pull coin mechanism for counting coins deposited into a vending machine, an arcade machine or a pay-per-use appliance, comprising:

a bracket assembly having a first substantially fixed arm and a second selectively pivotal arm;

a reed-switch attached to said first substantially fixed arm of said bracket assembly at a first end thereof;

a magnet attached to said second selectively pivotal arm of said bracket assembly at a first end thereof;

a spring assembly attached between said first and second arms of said bracket assembly, positioning said second arm in an open relationship to said first arm for an at-rest position of said switch assembly; and an arm extending from a top portion of said second selectively pivotal arm of said bracket assembly;

wherein said coins deposited into said vending machine, arcade machine or pay-per-use appliance interact with said arm of said switch assembly causing said arm to move in a substantially downward direction thereby causing said second selectively pivotal arm of said bracket assembly to pivot, causing said switch assembly to move from said at-rest position, and bringing said magnet proximate to said reed-switch thereby implementing a count of said coins.

7. A switch assembly as recited in claim 6, wherein said counts of said coins are displayed on a numeric display connected to said switch assembly by at least one lead.

8. A coin counter assembly for attachment to a push-pull coin mechanism found in vending machines, arcade machines or pay-per-use appliances, comprising:

a bracket assembly attached to said push-pull coin mechanism, comprising:

a first chamber for receiving, processing and then expelling at least one coin received from said coin mechanism;

a stop associated with said first chamber and positioned in such a way as to cause said at least one coin to be expelled from said coin mechanism having both horizontal and vertical momentum; and a second chamber having a switch assembly attached thereto, wherein said switch assembly is interactive with said at least one coin traveling through said first chamber in order to register counts on said coin counter;

a numeric display connected to the switch assembly by at least one lead, wherein said numeric display advances one sequence each time said at least one coin is processed through said first chamber of said bracket assembly; and a rod assembly attached to said bracket assembly between said coin mechanism and said bracket assembly in a position so as to be proximate to the location where said at least one coin leaves said coin mechanism when said bracket assembly is attached to said coin mechanism.

9. A coin counter assembly as recited in claim 8, said rod assembly having a length at least equal to the width of the opening of said first chamber, so that said at least one coin travels over said rod assembly.

10. A coin counter assembly as recited in claim 9, said rod assembly having a substantially circular cross-section.

11. A coin counter assembly as recited in claim 8, said switch assembly comprising:

a switch bracket assembly;

a reed-switch attached to said switch bracket assembly at a first position along said switch bracket assembly;

a magnet attached to said switch bracket assembly at a second position along said switch bracket assembly, wherein said second position pivots in relation to said first position;

a spring assembly attached at least to said second position of said switch bracket assembly, for positioning said magnet in an open relation to said reed-switch for an at-rest position of said switch assembly; and a switch arm extending from proximate said second position of said switch bracket assembly, and from said second chamber to said first chamber;

wherein said at least one coin deposited into said push-pull coin mechanism by a user thereof, interact with said switch arm during said processing of said at least one coin through said first chamber of said bracket assembly, causing said switch arm to pivot, thereby further causing said magnet to move from said at-rest position to be proximate to said reed-switch thereby implementing a count of said at least one coin.

12. A coin counter assembly as recited in claim 11, said switch bracket assembly further comprising a first substantially fixed arm and a second selectively pivotal arm, wherein said read-switch is attached to said first substantially fixed arm at a first end thereof, and said magnet is attached to said second selectively pivotal arm at a first end thereof.

13. A coin counter assembly as recited in claim 12, wherein said spring assembly is attached between said first and second arms of said switch bracket assembly, thereby positioning said second arm in an open relationship to said first arm.

14. A coin counter assembly as recited in claim 13, wherein said switch arm extends from a top portion of said second selectively pivotal arm of said switch bracket assembly located in said second chamber of said bracket assembly, into said first chamber of said bracket assembly to interact with said at least one coin.

15. A coin counter assembly as recited in claim 8, said switch assembly comprising:

a switch bracket assembly;

a magnet attached to said switch bracket assembly at a first position along said switch bracket assembly;

a reel-switch attached to said switch bracket assembly at a second position along said switch bracket assembly, wherein said second position pivots in relation to said first position;

a spring assembly attached at least to said second position of said switch bracket assembly, for positioning said reed-switch in an open relation to said magnet for an at-rest position of said switch assembly; and a switch arm extending from proximate said second position of said switch bracket assembly, and from said second chamber to said first chamber;

wherein said at least one coin deposited into said push-pull coin mechanism by a user thereof, interact with said switch arm during said processing of said at least one coin through said first chamber of said bracket assembly, causing said switch arm to pivot, thereby further causing said reed-switch to move from said at-rest position to be proximate to said magnet thereby implementing a count of said at least one coin.

16. A bracket assembly for attachment to push-pull coin mechanisms, wherein said push-pull coin mechanisms are found in vending and arcade machines and pay-per-use appliances, and wherein said bracket assembly is designed to receive thereon a switch assembly and have connected thereto a numeric display used to count coins deposited into said vending machine, arcade machine or pay-per-use appliance by a user thereof placing said coins into coin slots on said push-pull coin mechanism, comprising:

a first chamber for receiving, processing and then expelling coins from said push-pull coin mechanism before they drop into a coin receptacle in said vending machine, arcade machine or pay-per-use appliance, wherein said first chamber has at least one chamber divider extending substantially vertically through said first chamber, the quantity of said at least one divider dependent upon the number of said coin slots in said push-pull coin mechanism, so that said first chamber is substantially divided into sub-chambers equal in number to the number of said coin slots in said push-pull coin mechanism;

a second chamber located next to said first chamber for receiving therein said switch assembly; and a rod assembly attached to said bracket assembly between said coin mechanism and said bracket assembly, in a position so as to be proximate to the location where said coins leave said coin mechanism when said bracket assembly is attached to said coin mechanism.

17. A bracket assembly for attachment to push-pull coin mechanisms, wherein said push-pull coin mechanisms are found in vending and arcade machines and pay-per-use appliances, and wherein said bracket assembly is designed to receive thereon a switch assembly and have connected thereto a numeric display used to count coins deposited into said vending machine, arcade machine or pay-per-use appliance by a user thereof placing said coins into coin slots on said push-pull coin mechanism, comprising:

a first chamber for receiving, processing and then expelling coins from said push-pull coin mechanism before they drop into a coin receptacle in said vending machine, arcade machine or pay-per-use appliance, wherein said first chamber has at least one chamber divider extending substantially vertically through said first chamber, the quantity of said at least one divider dependent upon the number of said coin slots in said push-pull coin mechanism, so that said first chamber is substantially divided into sub-chambers equal in number to the number of said coin slots in said push-pull coin mechanism, and said first chamber further comprising a stop positioned along a bottom portion of said first chamber, whereby after said coins are processed in said first chamber, they deflect off of said stop thereby acquiring both horizontal and vertical momentum for their exit from said first chamber; and a second chamber located next to said first chamber for receiving therein said switch assembly.

18. A bracket assembly as recited in claim 17, said first chamber further comprising another stop positioned along atop portion of said first chamber in a location away from said second chamber, to stop substantially all horizontal momentum of said coins after they have left said coin mechanism and at the time of their receipt into said first chamber.

* * * * *